US007063604B2

(12) United States Patent
Spiegel

(10) Patent No.: US 7,063,604 B2
(45) Date of Patent: Jun. 20, 2006

(54) INDEPENDENT EDGE CONTROL FOR CMP CARRIERS

(75) Inventor: Larry A. Spiegel, San Luis Obispo, CA (US)

(73) Assignee: Strasbaugh, San Luis Obispo, CA (US)

( * ) Notice: Subject to any disclaimer, the term of this patent is extended or adjusted under 35 U.S.C. 154(b) by 0 days.

(21) Appl. No.: 11/072,636

(22) Filed: Mar. 4, 2005

(65) Prior Publication Data

US 2005/0202765 A1 Sep. 15, 2005

Related U.S. Application Data

(60) Provisional application No. 60/550,806, filed on Mar. 5, 2004.

(51) Int. Cl.
*B24B 5/00* (2006.01)

(52) U.S. Cl. ..... 451/285; 451/398; 451/402

(58) Field of Classification Search ..... 451/41, 451/285, 287, 397, 398, 402
See application file for complete search history.

(56) References Cited

U.S. PATENT DOCUMENTS 4,043,894 A * 8/1977 Gibbs ..... 204/297.03
5,795,214 A * 8/1998 Leon ..... 451/102
6,143,127 A * 11/2000 Perlov et al. ..... 156/345.14
6,228,233 B1 * 5/2001 Lakshmikanthan et al. . 204/277
6,368,189 B1 * 4/2002 Maloney et al. ..... 451/41
6,419,567 B1 * 7/2002 Glashauser ..... 451/259
6,676,497 B1 * 1/2004 Chen et al. ..... 451/288
6,716,094 B1 * 4/2004 Shendon et al. ..... 451/288
6,835,125 B1 * 12/2004 Tseng et al. ..... 451/398
6,855,037 B1 * 2/2005 Ashjaee et al. ..... 451/57
6,939,206 B1 * 9/2005 Ashjaee et al. ..... 451/41

* cited by examiner

*Primary Examiner*—Eileen P. Morgan
(74) *Attorney, Agent, or Firm*—K. David Crockett, Esq.; Marc J. Frechette; Crockett & Crockett

(57) ABSTRACT

A wafer carrier for controlling the edge effect during chemical mechanical planarization. A first bladder is disposed within the retaining ring to control the height of the retaining ring relative to the bottom surface of the wafer carrier. A second bladder is disposed within the carrier such that if the pressure in the bladder is regulated, the amount of force on the edge of the wafer changes. If a polishing process would cause material near the edge of the wafer to be removed at a higher rate than from the rest of the wafer, then the pressure is regulated within the bladder to reduce the force against the edge of the wafer. By reducing the force against the edge of the wafer, material is removed from the front side of the wafer at a uniform rate.

13 Claims, 6 Drawing Sheets

21
10
1
20
5
5
4
22
2
3
3
2
8
8
9
9
7
6

INDEPENDENT EDGE CONTROL FOR CMP CARRIERS

This application claims priority to U.S. Provisional Application 60/550,806, filed Mar. 5, 2004.

FIELD OF THE INVENTIONS

The inventions described below relate the field of wafer carriers and particularly to wafer carriers used during prime wafer polishing and chemical mechanical planarization.

BACKGROUND OF THE INVENTIONS

Integrated circuits, including computer chips, are manufactured by building up layers of circuits on the front side of silicon or other semiconductor wafers. An extremely high degree of wafer flatness and layer flatness is required during the manufacturing process. Chemical mechanical planarization (CMP) is a process used during device manufacturing to polish wafers and the layers built-up on wafers to the necessary degree of flatness.

Chemical mechanical planarization is a process involving the polishing of a wafer with a polishing pad combined with the chemical and physical action of a slurry pumped onto the pad. The wafer is held by a wafer carrier, with the backside of the wafer facing the wafer carrier and the front side (device side) of the wafer facing a polishing pad. A retaining ring extends downwardly from the outer portion of the wafer carrier and surrounds the outer edge of the wafer during polishing. The retaining ring thus prevents the wafer from being pulled or pushed away from the carrier during polishing. The retaining ring also affects how the pad contacts the edge of the wafer. In particular, the bottom surface of the retaining ring is kept even with the front surface of the wafer, thereby ensuring that the polishing pad evenly wears the wafer.

A polishing pad used to polish the wafer is held on a platen, which is usually disposed beneath the wafer carrier. Both the wafer carrier and the platen are rotated so that the polishing pad polishes the front side of the wafer. A slurry of selected chemicals and abrasives is pumped onto the pad to affect the desired type and amount of polishing.

By using this process, a thin layer of material is removed from the front side of the wafer or wafer layer. The layer may be a layer of oxide grown or deposited on the wafer or a layer of metal deposited on the wafer. The removal of the thin layer of material is accomplished to reduce surface variations on the wafer. Thus, the wafer and layers built-up on the wafer are very flat and/or uniform after the process is complete. Typically, more layers are added and the chemical mechanical planarization process repeated in subsequent polishing cycles. When all layers have been added and all cycles have been completed, a plurality of integrated circuit chips are built-up on the front side of the wafer.

A problem encountered during polishing is that a different amount of material is removed from the front side of the wafer near the outer edge of the wafer relative to the central portion of the front side of the wafer. (For the sake of simplicity, the portion of the front side of the wafer near the outer edge of the wafer shall be referred to as the edge of the wafer.) This type of wear is sometimes referred-to as the "edge effect." One way to handle the problem of the edge effect is to leave the edge of the wafer free of built-up devices. However, this method wastes available space on a wafer and is thus an inefficient method of manufacturing. Thus, improved methods and device are needed to reduce the edge effect and to polish wafers uniformly across the entire surface of a wafer.

SUMMARY

The methods and devices described below provide for a wafer carrier adapted to greatly reduce the edge effect and allow a wafer to be uniformly polished across its entire surface. An inflatable tubular hoop bladder or resilient ring is disposed above the edge of a wafer during polishing. Pressure in the bladder is regulated to compensate for the edge effect.

For processes in which the rate of material removal from the edge of the wafer is greater than the rate of material removal from the central portion of the wafer (center slow processes), pressure in the bladder is regulated such that less force is applied to the edge of the wafer than to the central portions of the front side of the wafer. For processes in which the rate of material removal from the edge of the wafer is less than the rate of material removal from the central portion of the front side of the wafer (center-fast processes), pressure in the bladder may be regulated to apply more force to the edge of the wafer. In both cases, the rate at which polishing removes material from the edge of the wafer is adjusted to be about equal to the rate at which polishing removes material from the central portion of the front-side of the wafer.

To improve the polishing process, a second inflatable tubular hoop bladder or resilient ring is disposed in a groove above the retaining ring. An annular ridge disposed in the bottom of the groove presses into the bladder during use. Pressure in the second bladder may be regulated to ensure that the bottom of the retaining ring, which is capable of moving vertically with respect to the wafer carrier, remains at a particular height with respect to the wafer.

DETAILED DESCRIPTION OF THE INVENTIONS

Figure 1:
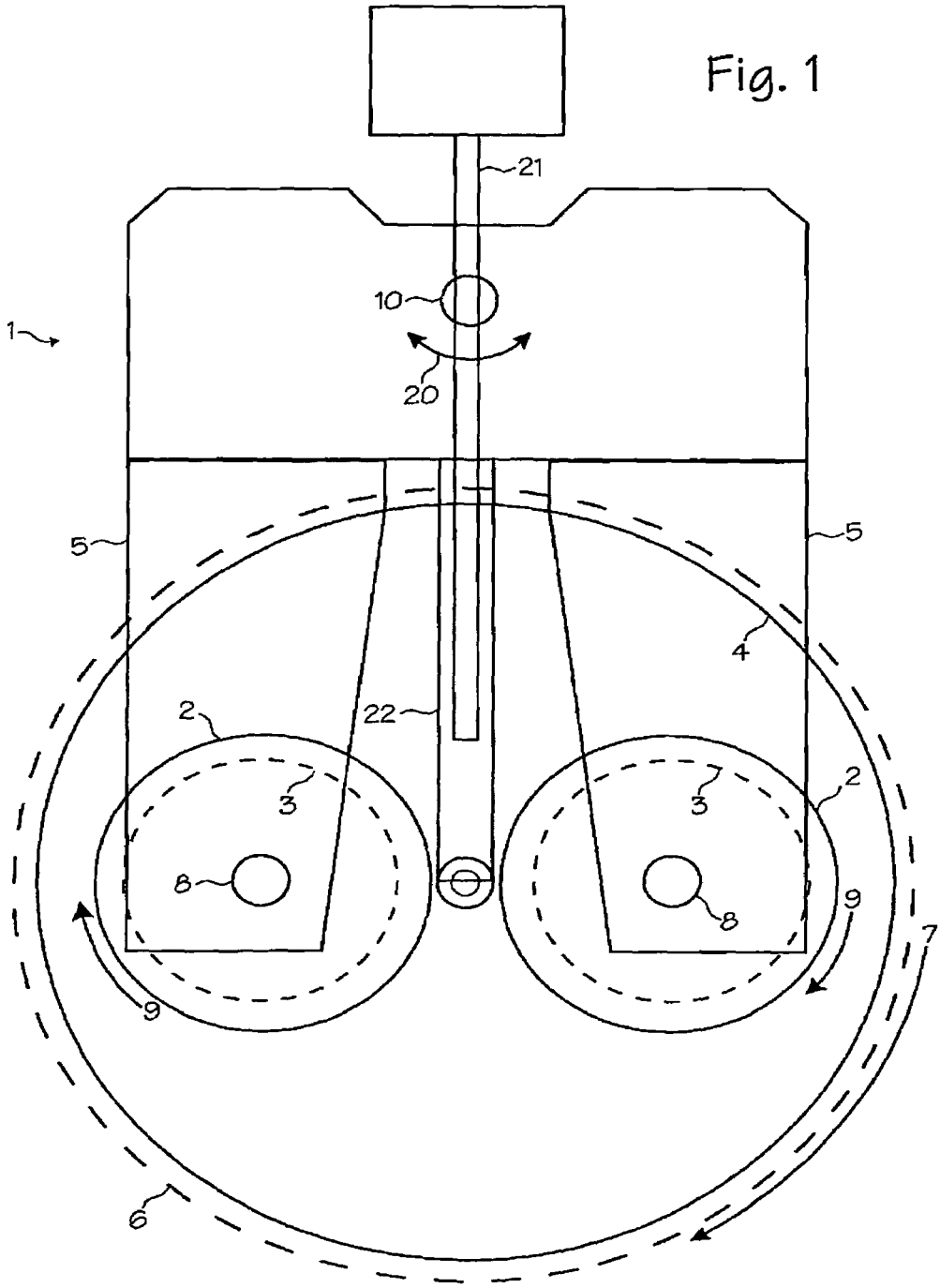
FIG. 1 shows a system for performing chemical mechanical planarization.

FIG. 1 shows a system 1 for performing chemical mechanical planarization. One or more polishing heads or wafer carriers 2 hold wafers 3 (shown in phantom to indicate their position underneath the wafer carrier) suspended over a polishing pad 4. A wafer carrier thus has a means for securing and holding a wafer. The wafer carriers are suspended from translation arms 5. The polishing pad is disposed on a platen 6, which spins in the direction of arrows 7. The wafer carriers 2 rotate about their respective spindles 8 in the direction of arrows 9 (though the wafer carriers may also rotate in the opposite direction). The wafer carriers are also translated back and forth over the surface of the polishing pad by the translating spindle 10, which moves as indicated by arrows 20. The slurry used in the polishing process is injected onto the surface of the polishing pad through slurry injection tube 21, which is disposed on or through a suspension arm 22. (Other chemical mechanical planarization systems may use only one wafer carrier that holds one wafer, or may use several wafer carriers that hold several wafers. Other systems may also use separate translation arms to hold each carrier.)

Figure 2:
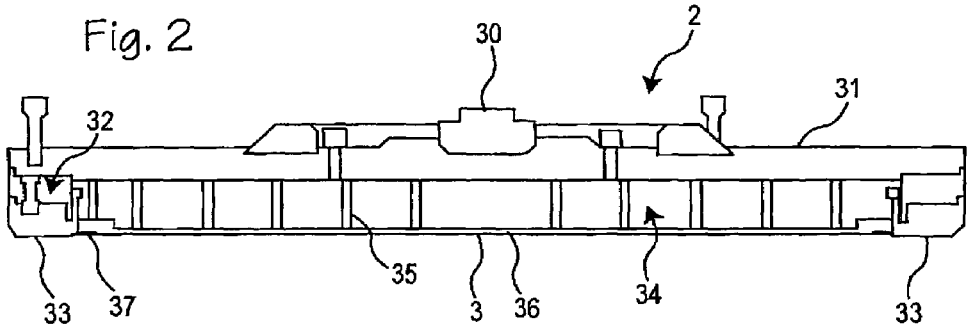
FIG. 2 shows a cross section of a wafer carrier.

FIG. 2 shows a cross section of a wafer carrier 2. The wafer carrier includes a spindle 30 for rotating the carrier, a top plate 31 attached to the spindle, a housing 32 attached to the top plate, a retaining ring 33 attached to the housing and a mounting plate 34 attached to the top plate. The mounting plate is disposed within the inner diameters of the housing and retaining ring. The mounting plate is provided with a plurality of holes 35 to regulate air pressure between the wafer 3 and a plenum 36 between the mounting plate and the wafer. During wafer transfer, a vacuum maintained through the holes draws the wafer against the wafer carrier. During polishing, positive pressure may be applied through the holes to press the wafer against the polishing pad.

A lip seal 37 may be provided between the mounting plate and the backside of the wafer. An example of a wafer carrier having a lip seal may be found in Breivogel, et al., Method and Apparatus for Chemical-Mechanical Polishing Using Pneumatic Pressure Applied to the Backside of a Substrate, U.S. Pat. No. 5,635,083 (Jun. 3, 1997).

Figure 3:
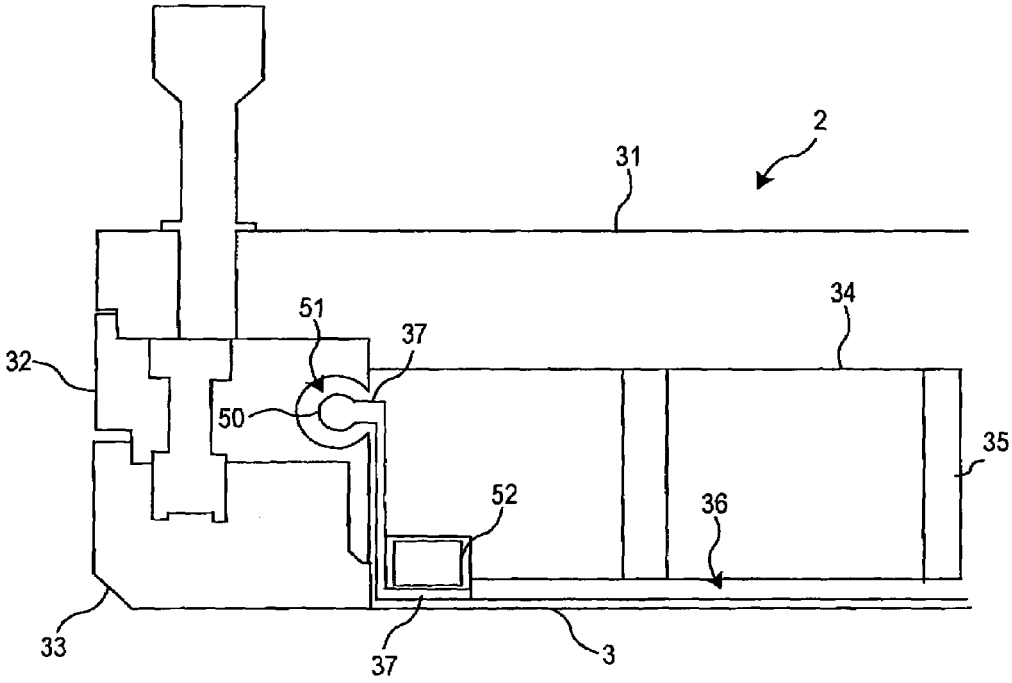
FIG. 3 shows an enlarged section of the wafer carrier shown in FIG. 2.

FIG. 3 shows an enlarged section of the wafer carrier 2 shown in FIG. 2. The lip seal 37 extends horizontally over a peripheral portion of the backside of the wafer and vertically between the mounting plate 34 and the retaining ring 33 and housing 32. An extension 50 of the membrane projects into an annular space 51 provided in the housing. The extension is smaller than the space and may move within the space. Thus, the lip seal moves with the wafer and the mounting plate but, during polishing, moves independently of the movement of the housing and the retaining ring.

A tubular hoop bladder 52 is provided between the lip seal and the mounting plate. (Because the bladder is used to control the edge effect, the bladder may be referred to as an edge control bladder.) In use, pressure inside the edge control bladder is regulated to either increase or decrease the amount of force the lip seal applies along the edge of the wafer. For center-slow processes, pressure in the bladder is regulated such that the amount of force applied to the wafer in the area of the lip seal is less than the amount of force applied to the rest of the wafer. (Downward force on the wafer is applied via the downward force applied by the carrier and by positive pressure in the plenum.) Because less force is applied to the edge of the wafer than the central portion of the wafer, the edge effect is lessened. The lip seal and the edge of the wafer move up and down relative to the carrier, thereby allowing the force applied to the edge of the wafer to vary relative to the force applied to the rest of the wafer. Thus, pressure in the edge control bladder may be regulated such that the rate at which polishing removes material from the wafer is uniform across the entire front side of the wafer.

Because the lip seal is attached to the wafer mounting plate and is not attached to the retaining ring, an operator may account for changes in the height of the retaining ring. (Polishing removes material from the bottom surface of the retaining ring, particularly over the course of multiple polishing procedures.) Because the lip seal moves independently of the retaining ring, pressure in the bladder may be regulated to adjust the height of the wafer relative to the retaining ring. Thus, the front side of the wafer will remain substantially co-planar with the bottom surface of the retaining ring even as material is removed from the bottom surface of the retaining ring.

Moreover, the edge control bladder may be combined with a mechanism for regulating the height of the retaining ring. For example, our own patent application Ser. No. 10/680,995 filed Oct. 7, 2003, the entirety of which is hereby incorporated by reference, shows devices and methods for controlling the height of the retaining ring relative to the wafer carrier. A hoop bladder is provided within the retaining ring. The retaining ring is attached to the housing in a manner that allows the retaining ring to move up and down relative to the housing. Pressure is regulated inside the retaining ring bladder to force the retaining ring downwardly as material is removed from the bottom surface of the retaining ring. If the retaining ring bladder is included with a carrier having the edge control bladder, the pressure in each bladder is regulated independently of each other.

In addition, the bladder and lip seal reduce vibration of the carrier system, which includes the wafer carrier and the wafer. Pressure in the bladder may be adjusted to reduce the amount of vibration in the carrier system.

Figure 4:
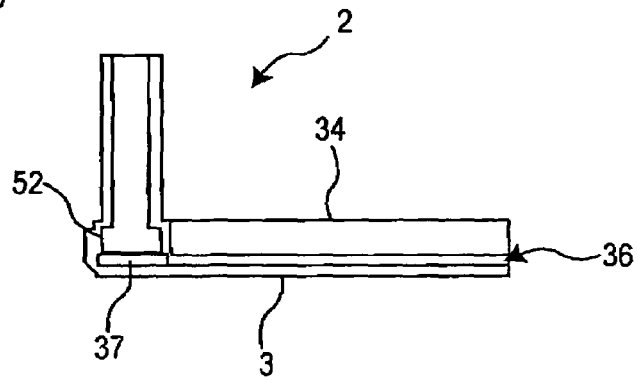
FIG. 4 shows a cross section of a wafer carrier.

FIG. 4 shows a cross section of another wafer carrier 2. The bladder 52 and lip seal 37 are formed into an integral unit. The function of the bladder and lip seal is the same as that shown in FIG. 3, though the single unit increases the efficiency of carrier manufacturing.

Figure 5:
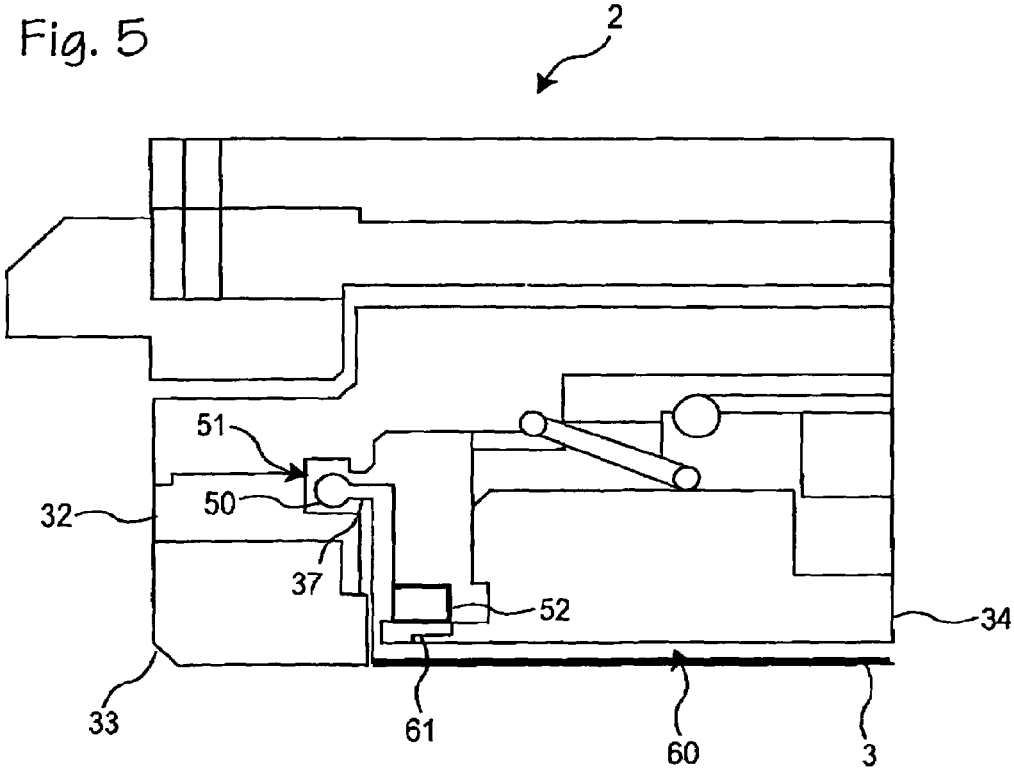
FIG. 5 shows a cross section of a wafer carrier.

FIG. 5 shows a cross section of another wafer carrier 2. In some wafer carriers, such as that shown in our own patent, Strasbaugh, Wafer Carrier for Film Planarization, U.S. Pat. No. 5,449,316 (Sep. 12, 1995), a membrane 60 extends across the entire area within the inner diameter of the retaining ring 33 (opposite the bottom surface of the mounting plate 34). Thus, the backside of the wafer 3 is disposed against the membrane 60. The edge control bladder 52 is placed above the membrane 37, 60 near the area corresponding to the location of the edge of the wafer during polishing. An annular space 51 is provided within the carrier to allow the membrane projection 50 to move up and down within the carrier as the membrane is pushed up and down during polishing. Pressure in the bladder 52 is adjusted to ensure that the rate at which material is removed from the front side of the wafer is uniform across the entire front side of the wafer.

For existing wafer carriers, a shim ring 61 or an annular strip of material may be provided to adjust the height of the bladder relative to the membrane or to adjust the radial distance of the bladder relative to the axis of the carrier. Some existing wafer carriers are more easily modified to include the edge control bladder if the shim ring is placed within the carrier.

Figure 6:
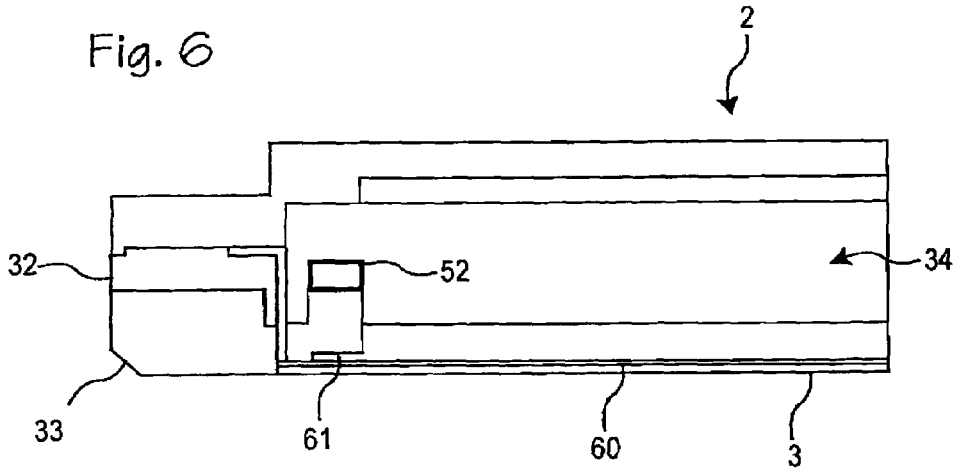
FIG. 6 shows a cross section of a wafer carrier.

FIG. 6 shows a cross section of a wafer carrier 2 similar to the carrier shown in FIG. 5. The edge control bladder 52 is disposed between an annular shim ring 61 and the mounting plate 34. The shim ring is inserted in existing wafer carriers to help accommodate the edge control bladder. The shim ring is sized and dimensioned such that the surface of the shim ring contacting the membrane will be disposed over the location where the edge of the wafer would be located during polishing. Pressure in the bladder is regulated to ensure a uniform material removal rate across the entire front side of the wafer. The pressure which is applied to the edge of the membrane and its location depend by the both on the pressure in the edge-control bladder and the area and shape of contact by that bladder on the shim ring and the relative contact area and shape of the shim ring on the membrane which contacts the wafer. Thus, various shim ring area-ratio geometries can be used to attain a different range of pressures and locations on the membrane edge in order to achieve this desired uniform removal rate.

Figure 7:
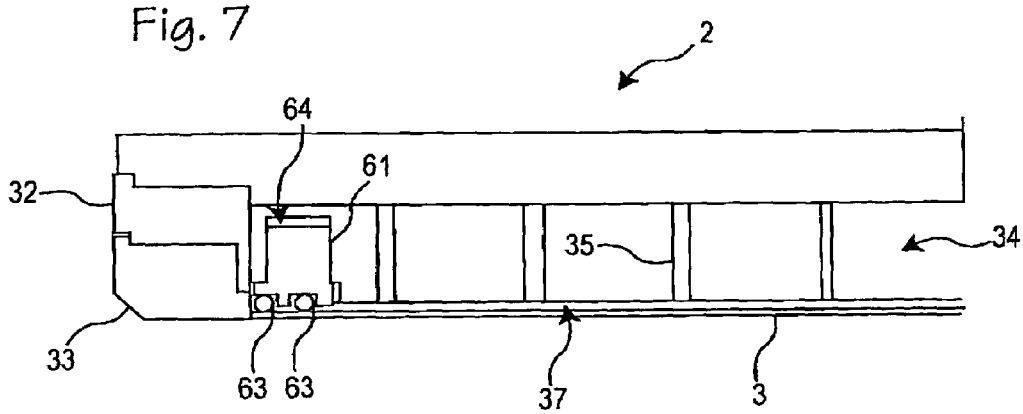
FIG. 7 shows a cross section of a wafer carrier.

FIG. 7 shows a cross section of a wafer carrier 2 wherein no membrane is provided between the carrier and the wafer. An annular shim ring 61 of resilient material is provided within an annular groove 62 in the mounting plate 34. The shim ring is sized and dimensioned to extend over the location where the edge of the wafer would be located during polishing. One or more O-rings 63 may be provided to aid in forming a seal between the wafer and the shim ring.

The shim ring is further sized and dimensioned such that a space 64 forms between the top surface of the shim ring and the top of the slot. The space is sealed between the shim ring and the mounting plate 34 so that pressure may be regulated within the space via a pressure source in fluid communication with the space. The amount of force the shim ring exerts on the edge of the wafer 3 during polishing is regulated to lessen the force applied to the edge of the wafer in order to reduce the edge effect. Thus, material is removed at a uniform rate across substantially the entire surface of the front side of the wafer.

Active regulation of the pressure in the space is not required. A passive annular bladder filled with air pressurized to a predetermined pressure or a ring of resilient material may be placed within the annular space. The pressure in the bladder or the resiliency of the material is selected to adjust the force applied to the edge of the wafer in order to ensure a uniform rate of material removal from the front side of the wafer.

In addition, as material is worn from the bottom surface of the retaining ring 33, the bladder gradually compresses or the resilient material is gradually compressed because more force is applied to the edge of the wafer. As a result, the surface of the edge of the wafer remains in acceptable vertical relationship with the with the bottom surface of the retaining ring. (The bladder, resilient ring or retaining ring may be replaced when pressure in the bladder or resilient ring becomes high enough that the wafer and membrane can no longer move upwardly during polishing.)

Figure 8:
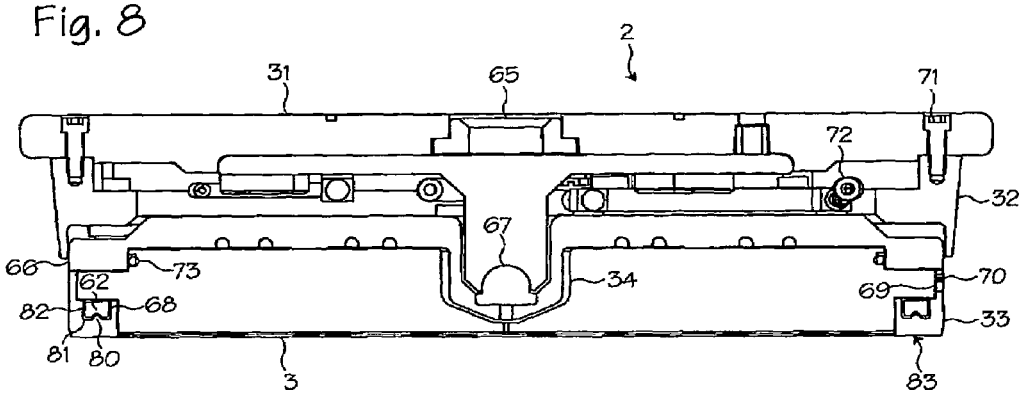
FIG. 8 shows a cross section of an assembled wafer carrier operable with the system of FIG. 1.
Figure 9:
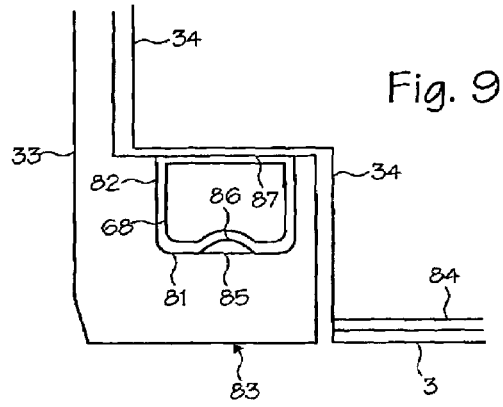
FIG. 9 shows a blown-up cross section of the retaining ring.

FIGS. 8 and 9 show cross sections of an assembled wafer carrier 2 operable with the system of FIGS. 1 through 7. Similar systems are shown in our U.S. application Ser. No. 10/680,995, filed Oct. 7, 2003, the entirety of which is hereby incorporated by reference. Various parts of the wafer carrier are shown in relation to each other, including the top plate 31, spindle socket 65, carrier housing 32, manifold plate 66, mounting plate 34, pivot mechanism 67, retaining ring 33, inflatable bladder 68 and part of the slot 69 and screw 70 arrangement that slidably attaches the retaining ring to the mounting plate. Some of the fasteners 71, tubes 72 and O-rings 73 are also shown with the carrier to show the context of the inventions described herein. Components 71, 72 and 73 are used in one of our wafer carrier models to perform various functions before, during or after polishing.

As shown in FIG. 8, the retaining ring 33 is provided with a triangular ridge 80 integrally formed with the floor 81 of the rectangular groove 62. The ridge extends around the retaining ring such that the ridge forms a ring having a triangular cross section. The ridge also extends upwardly towards the mounting plate 34 a distance sufficient to deform the inflatable bladder 68 to the point where the walls of the bladder very closely conform to the shape of the groove when the inflatable seal is pressurized to a nominal ambient pressure, typically about 5 PSI to about 60 PSI. Thus, the inflatable bladder is pre-deformed to conform to the shape of the retaining ring before additional fluid is provided to the inflatable bladder. (Since the ridge causes the inflatable bladder to conform very closely to the shape of the retaining ring, the engineering tolerances required for the inflatable bladder and the retaining ring are thereby greatly reduced.)

The ridge 80 is disposed within the groove 62 so that the ridge is symmetrically disposed relative to the bladder walls; that is, the walls of the bladder abut the walls 82 of the groove. Thus, the portions of the bladder to either side of the ridge apply equal pressure to the ridge and the floor of the groove. For most of our retaining rings, the ridge preferably is also disposed symmetrically between the groove walls 82 so that the distance between one groove wall and a corresponding wall of the ridge is equal to the distance between the other groove wall and the other wall of the ridge. The bladder is pinched, or partially collapsed, between the mounting plate 34 and the ridge 80. Since the groove walls and the mounting plate are rigid and fixed in the manner described above, as pressure is increased in the bladder the bladder forces the retaining ring to travel downwardly, away from the mounting plate. Thus, the bottom surface of the retaining ring may be maintained at a predetermined or desired level relative to the front side of the wafer even as the bottom surface of the retaining ring is worn away. The inflatable bladder also ensures that the down force or pressure at the bottom surface 83 of the retaining ring is evenly distributed.

FIG. 9 shows a detailed cross section of the retaining ring 33. The mounting plate 34, insert 84 and wafer 3 are separated from the retaining ring to show more clearly the retaining ring and inflatable bladder 68. FIG. 9 shows a ridge 85 having a rounded or hemispherical cross section. The ridge may be differently sized and shaped, so long as the inflatable bladder is pre-deformed to conform very closely to the size and shape of the groove in the retaining ring.

The shape of the ridge affects how the retaining ring puts pressure onto the polishing pad, thus the shape of a ridge or ridges disposed in the retaining ring may be adjusted to change the performance of a retaining ring. The placement of the ridge within the retaining ring also changes the performance of the retaining ring. For example, a lopsided ridge, such as a right triangle, or a ridge asymmetrically disposed relative to the walls of the bladder will cause the retaining ring to lean with respect to the axis of the wafer carrier. In other words, the retaining ring will place more pressure towards either the leading edge or the trailing edge of the bottom surface of the retaining ring.

In addition, the ridge shown in FIG. 9 may be disposed on a second ring 86 that is mounted to the floor of the groove. The second ring has a hemispherical cross section, as shown in FIG. 9. Thus, the ridge need not be integrally formed with the retaining ring and the ridge may be provided as a separate ring mounted to the retaining ring. In addition to forming the ridge, the second ring also reinforces the retaining ring, especially if the second ring is made from a material that is stiffer than the material from which the retaining ring is made. The second ring also decreases the depth of the groove, which may further help the bladder to more closely conform to the shape of the groove and may affect how the bladder expands within the groove (depending on the shape of the bladder).

In other wafer carriers, a second ring (or even third ring) could be mounted to the groove to change the effective shape of the groove. Thus, the effective dimensions of the groove could be changed to conform to the size and dimensions of an available bladder. For example, a second ring having a concave, hemispherical cross section may be mounted to the floor of the groove so that an available cylindrical bladder will substantially conform to the size and dimensions of the groove. (A second ring having a convex hemispherical cross section would create the effect of a ridge, similar to that shown in FIG. 9.

Figure 11:
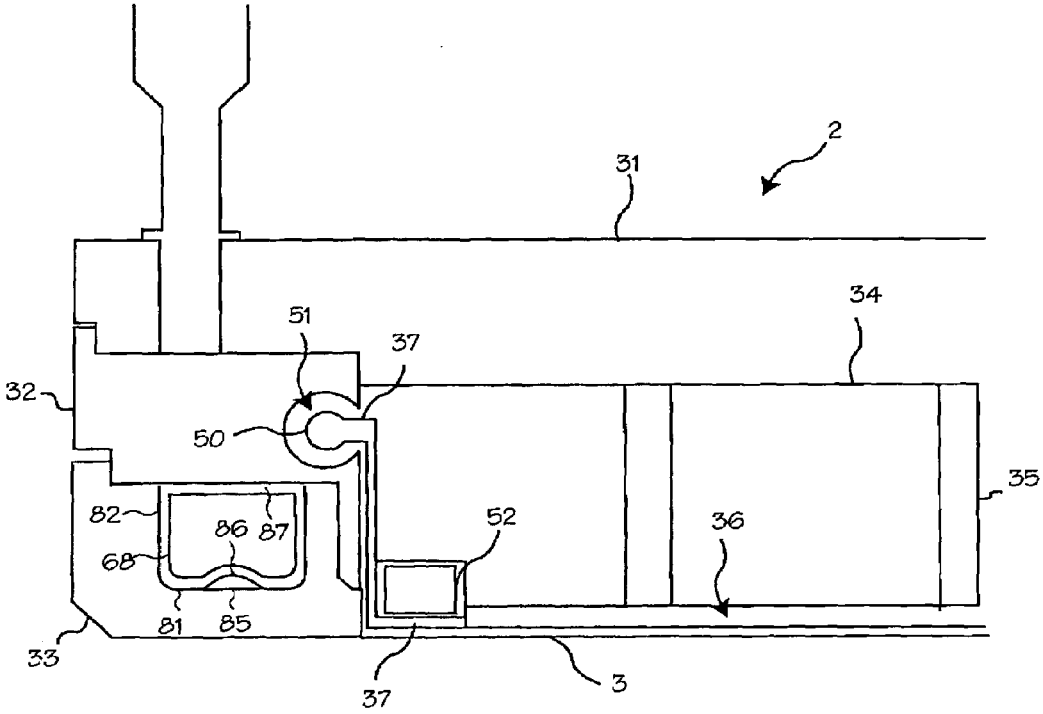
FIG. 11 shows a magnified cross-section of a wafer carrier having an edge control bladder and a retaining ring with a groove and an inflatable bladder.

The retaining ring shown in FIGS. 8 and 9 has a groove with an opening facing the mounting plate so that, in use, the bladder is pinched between the floor of the groove and the mounting plate. However, the groove may be provided with a flexible roof 87, in which case the groove may be referred to as a duct. The bladder is disposed in the duct. In use, the duct roof would deform with the bladder, causing the roof to press against the mounting plate and thereby causing the retaining ring to move along the axis of the wafer carrier. FIG. 11 shows a magnified cross-section of a wafer carrier having an edge control bladder as illustrated in FIG. 3 having a retaining ring with a groove and an inflatable bladder as illustrated in FIG. 9.

Figure 10:
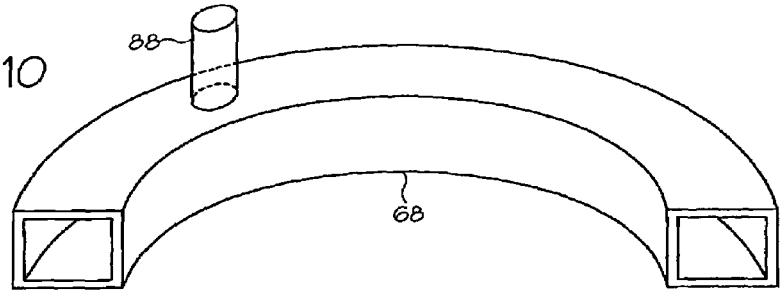
FIG. 10 shows a portion of the inflatable bladder.

FIG. 10 shows a radial cross section of the inflatable bladder 68 and shows the fluid supply tube 88 attached to the inflatable bladder. As described in reference to FIGS. 1 through 9, the inflatable bladder is a resilient tubular hoop having a rectangular cross section. The inflatable bladder may have other cross sections and sizes, so long as the inflatable bladder may be inflated to conform substantially to the size and dimensions of the groove in the retaining ring. In addition, the inflatable bladder may be shaped, sized and dimensioned so that the bladder preferentially expands in a particular direction when the bladder is not otherwise constrained. (Thus, for some applications, less pressure is needed to deform the bladder, meaning that the same pressure will force the retaining ring to slide more towards the polishing pad.) The fluid supply tube may extend from any particular portion of the inflatable bladder, as required for operably disposing the tube within the wafer carrier and connecting it to the fluid supply.

In one of our own wafer carrier models, the inflatable bladder is preferably made from ethylene propylene diene monomer (EPDM) rubber. The inflatable bladder may be made from other materials, such as other rubbers or silicone, for use in different wafer carriers. The bladder is built to withstand normal operating pressures, typically about 1 PSI to about 60 PSI, preferably about 30 PSI. These bladder pressures cause the retaining ring to impart a pressure onto the polishing pad in the range of about 0 PSI to about 12 PSI.

In the same carrier, the slots and screws are sized and dimensioned to allow the retaining ring to move at least 0.030 inches along the direction of the wafer carrier axis. Preferably, the slots and screws are sized and dimensioned to allow the retaining ring to move 0.090 inches or more along the direction of the wafer carrier axis. The ridge extends from about 0.005 to about 0.100 inches or more from the floor of the groove, depending on the size and shape of the bladder and the size and shape of the retaining ring. Preferably, the ridge extends about 0.030 inches from the floor of the groove and is about 0.090 inches wide at the base relative to the width of the groove. Preferably, the groove is about 0.283 inches wide and about 0.215 inches deep. The retaining ring itself is preferably about 0.985 inches wide along its bottom surface and about 0.415 inches high from the lip of the groove to the bottom surface of the retaining ring. (Width refers to a distance along a radial line of the carrier and depth or height refers to a distance along a line parallel to the axis of the carrier.)

As described in reference to the figures, the ridge deforms the bladder to conform very closely to the shape of the groove. To accomplish this, the ridge need not be disposed on the floor of the retaining ring. The ridge may depend downwardly into the groove from the mounting plate or extend radially into the groove from either of the two walls of the groove in the retaining ring. Moreover, the ridge need not be symmetrically located within the groove. In other wafer carriers, multiple ridges are provided and each extends into the groove. Multiple ridges asymmetrically disposed within the retaining ring may be provided, with each ridge extending into the groove from one or more surfaces. In any case, the ridge should cause the inflatable bladder to conform very closely to the size and dimensions of the groove before pressure is added to the bladder.

In other wafer carriers, the inflatable bladder need not be connected to a fluid supply and instead may be pressurized sufficiently to urge the retaining ring towards the polishing pad when inserted into the carrier. However, in this configuration the pressure the retaining ring applies to the polishing pad cannot be adjusted.

In addition, other mechanisms may be provided to allow the retaining ring to be slidably attached to the mounting plate or other parts of the wafer carrier. For example, one or more lugs 69 may be provided in the mounting plate 34. If provided, the lugs are slidably disposed within corresponding grooves 70 disposed in the retaining ring. (Lugs 69 and grooves 70 are shown in FIG. 8.) Stops disposed on the lugs limit the vertical travel of the retaining ring. The lugs also help transfer torque from the mounting plate to the retaining ring.

Additional features of the wafer carriers are shown in U.S. Provisional Application 60/550,806. Thus, while the preferred embodiments of the devices and methods have been described in reference to the environment in which they were developed, they are merely illustrative of the principles of the inventions. Other embodiments and configurations may be devised without departing from the spirit of the inventions and the scope of the appended claims.

I claim:

1. A wafer carrier comprising a means for securing and holding a wafer, said wafer carrier further comprising:

a mounting plate;

a retaining ring slidably attached to the mounting plate such that the retaining ring may move a distance along the axis of the wafer carrier independent of the mounting plate, said retaining ring having by an inner diameter and having a groove disposed within a top surface of the retaining ring;

an inflatable bladder disposed within the groove, said inflatable bladder sized and dimensioned to substantially conform to the size and dimensions of the groove; and a membrane extending across the bottom surface of the wafer carrier, said membrane further disposed within the inner diameter of the retaining ring.

2. The wafer carrier of claim 1 further comprising a ridge extending into the groove, wherein the ridge extends from a component of the wafer carrier selected from the group consisting of the mounting plate and the retaining ring.

3. The wafer carrier of claim 1 further comprising a second bladder disposed within the wafer carrier, said second bladder further disposed such that pressure changes in the bladder will change the force applied to the edge of a wafer held by the wafer carrier.

4. The wafer carrier of claim 1 further comprising a shim ring disposed within the inner diameter of the retaining ring, said shim ring further disposed over the edge of the wafer.

5. The wafer carrier of claim 4 further comprising an o-ring disposed within a groove in the shim ring.

6. The wafer carrier of claim 4 further comprising a space disposed within a housing of the wafer carrier, wherein the membrane extends into the space and is sized and dimensioned to move within the space.

7. The wafer carrier of claim 3 further comprising a shim ring disposed between the second bladder and the membrane wherein the force applied to the edge of the wafer is determined by the ratio of areas of contact of the second bladder on the shim ring and the shim ring on the membrane.

8. A wafer carrier comprising a housing and a means for securing and holding a wafer, said wafer carrier further comprising:

a retaining ring;

a mounting plate operatively attached to the housing, said mounting plate adapted to hold the wafer;

a hoop bladder disposed within an inner diameter of the retaining ring, said hoop bladder further disposed over the edge of the wafer during polishing; and a lip seal operably coupled to the housing such that the lip seal moves independently of the retaining ring and rests against the wafer during polishing.

9. The wafer carrier of claim 8 further comprising a membrane operatively attached to the mounting plate.

10. The wafer carrier of claim 8, wherein the hoop bladder is disposed between the mounting plate and the lip seal.

11. The wafer carrier of claim 8 further comprising a space disposed within a housing of the wafer carrier, wherein the lip seal extends into the space and is sized and dimensioned to move within the space.

12. The wafer carrier of claim 8 wherein pressure inside the hoop bladder is regulated to control an amount of force the lip seal applies along an edge of wafer.

13. The wafer carrier of claim 8 wherein the hoop bladder and the lip seal are integrally formed.

* * * * *